US006904859B1

(12) United States Patent
Gieseke

(10) Patent No.: US 6,904,859 B1
(45) Date of Patent: Jun. 14, 2005

(54) INLET FREE TORPEDO LAUNCH SYSTEM

(75) Inventor: Thomas J. Gieseke, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/816,484

(22) Filed: Apr. 2, 2004

(51) Int. Cl.[7] ..... B63B 1/00; B63B 5/00

(52) U.S. Cl. ..... 114/238; 114/316; 114/318; 114/319; 114/320; 89/1.81

(58) Field of Search ..... 114/238, 239, 114/316, 318, 319, 320; 89/1.51

(56) References Cited

U.S. PATENT DOCUMENTS

| | | | | | |
|---|---|---|---|---|---|
| 2,837,971 | A | * | 6/1958 | Wosak | 89/5 |
| 2,848,970 | A | * | 8/1958 | Gunning | 114/319 |
| 4,523,538 | A | * | 6/1985 | Hollmann et al. | 114/238 |
| 4,848,210 | A | * | 7/1989 | Bissonnette | 89/1.81 |
| 5,044,253 | A | * | 9/1991 | Moody | 89/1.81 |
| 5,085,122 | A | * | 2/1992 | Berlam et al. | 89/1.81 |
| 5,165,360 | A | * | 11/1992 | Moody | 114/319 |
| 5,410,978 | A | * | 5/1995 | Waclawik et al. | 114/238 |
| 5,834,674 | A | * | 11/1998 | Rodriguez et al. | 89/1.81 |
| 6,216,626 | B1 | * | 4/2001 | Curtis | 114/238 |
| 6,584,924 | B2 | * | 7/2003 | Jordan | 114/238 |
| 6,595,098 | B1 | * | 7/2003 | Wray | 89/1.809 |

FOREIGN PATENT DOCUMENTS

| | | | | |
|---|---|---|---|---|
| DE | 3406921 A1 | * | 9/1985 | F41F/3/10 |
| DE | 3704343 A1 | * | 8/1998 | B63G/8/32 |

OTHER PUBLICATIONS

Examination of a Torpedo Performance Space and Its Relation to the System Design Space, Frits et al. available @ http://sbd.npt.nuwc.navy.mil/documents/AIAA2002b.pdf.*

McCue, Gary, USS Holland Weapons Systems, Copyright 1999, Available @ http://www.geocities.com/gwmccue/Systems/Weapons_System.html.*

* cited by examiner

*Primary Examiner*—Michael Carone
*Assistant Examiner*—Daniel Lawson Greene, Jr.
(74) *Attorney, Agent, or Firm*—James M. Kasischke; Michael P. Stanley; Jean-Paul A. Nasser

(57) ABSTRACT

A launcher for torpedoes and underwater vehicles includes an inlet recess in fluid communication with a shutterway recess. A primary shutterway is provided both for ejection of the vehicle and for supplying fluid intake to the launcher. A pump circulates fluid from the inlet recess to the shutterway recess, and a launch tube houses a vehicle such as a weapon, within the launcher prior to launch thereof. A slide valve and impulse tank combination are positioned intermediate the pump and the launch tube, such that the slide valve controls a flow of fluid to the launch tube. A guide can is positioned at the shutterway recess for guiding the vehicle from the launch tube to an exterior of the launcher and fluid within the launcher is continually moderated to enable selective launch of the vehicle with a fluid force.

6 Claims, 4 Drawing Sheets

INLET FREE TORPEDO LAUNCH SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The invention generally relates to a launch system and more particularly to a launcher which eliminates the need for an inlet door for a supply of fluid for launch by using an alternatively configured fluid flow.

(2) Description of the Prior Art

The current art for torpedo launch systems with a pressurizing pump have a "U" configuration where one end of the "U" is a flow intake, the bottom of the "U" contains the pump, and the other end of the "U" is the torpedo tube. To operate, the intake end of the launch system includes a large and complex hydraulically actuated door.

A prior art turbine pump ejection system (TPES) 100 is shown, by way of example, in FIG. 1 of the drawings. The turbine pump ejection system 100 includes an inlet door 102 opening to an inlet recess 104. The inlet recess 104 supplies seawater as the system fluid to an inlet cylinder 106 as a result of a turbine pump 108 drawing seawater into the inlet cylinder and pumping seawater into an impulse tank 110, through a slide valve 112, down a torpedo tube 114, through a shutterway recess 116, and out of the platform via a primary shutterway 118.

In operation, the inlet door 102, the slide valve 112, the primary shutterway 118 and a secondary shutterway 120 are opened to create an open flow path through the launch system 100.

Prior to launch, the pressure in the inlet recess 104 and the pressure in the shutterway recess 116 each independently increase to some fraction of the available dynamic head, as a result of forward motion of the system through the ocean. Any imbalance between the pressure in the inlet recess 112 and the shutterway recess 116 causes fluid in the launch system, and any device in the torpedo tube 114, to move.

When a launch is initiated, the turbine pump 108 begins to rotate and fluid is drawn though the inlet door 102, the inlet recess 104, the inlet cylinder 106 and into the turbine pump 108. The turbine pump 108 pumps fluid into the impulse tank 110, through the slide valve 112, down the torpedo tube 114 carrying the weapon in the torpedo tube through the shutterway recess 116 and out of the system 100 via the primary shutterway 118.

The following reference, for example, discloses an external fluid intake apart from the operating launch tube, but does not disclose an internally circulating fluid path which eliminates an inlet door.

Wosak (U.S. Pat. No. 2,837,971) discloses hydraulic ejection equipment for missiles. Specifically, the reference discloses a system having a water-filled cylinder communicating at one end with the sea and communicating at its other end, through ports in its walls and a passageway or conduit, with the aft end of a missile ejector tube whose fore or discharge end communicates with the sea. A piston is mounted for reciprocating movement in the water cylinder with the piston is connected to a suitable driving mechanism for moving the piston from its retracted position to force water ahead of the piston through the ports in the forward end of the water cylinder though the conduit connecting those ports with the aft end of the missile ejector tube thereby to charge the water into the ejector tube and behind the missile in the tube and in a sufficient amount and with sufficient force to expel the missile from the tube with a force and velocity.

It should be understood that the present invention would in fact enhance the functionality of the launching systems by providing a launcher design which eliminates the need for an intake door.

SUMMARY OF THE INVENTION

Accordingly, it is a general purpose and primary object of the present invention to provide a launcher system with a fluid intake door eliminated as a component of the launcher.

It is a further object of the present invention to provide a launcher system which provides a common path for fluid intake and vehicle exit.

It is a still further object of the present invention to provide a launcher which corrects reverse fluid flow in existing systems.

In accordance with one aspect of the present invention, there is provided an inlet free launcher system including an inlet recess in fluid communication with a shutterway recess. A primary shutterway is provided both for ejection of a vehicle and for supplying fluid intake to the system. A pump selectively circulates fluid from the inlet recess to the shutterway recess, and a launch tube houses the vehicle, such as a weapon, within the system prior to launch thereof. A slide valve and impulse tank combination are positioned intermediate the pump and the launch tube, such that the slide valve controls a flow of fluid to the launch tube. A guide can is positioned in the shutterway recess for guiding the vehicle from the launch tube to an exterior of the launcher and fluid within the system is continually moderated to enable selective launch of the vehicle with a fluid force.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 2:
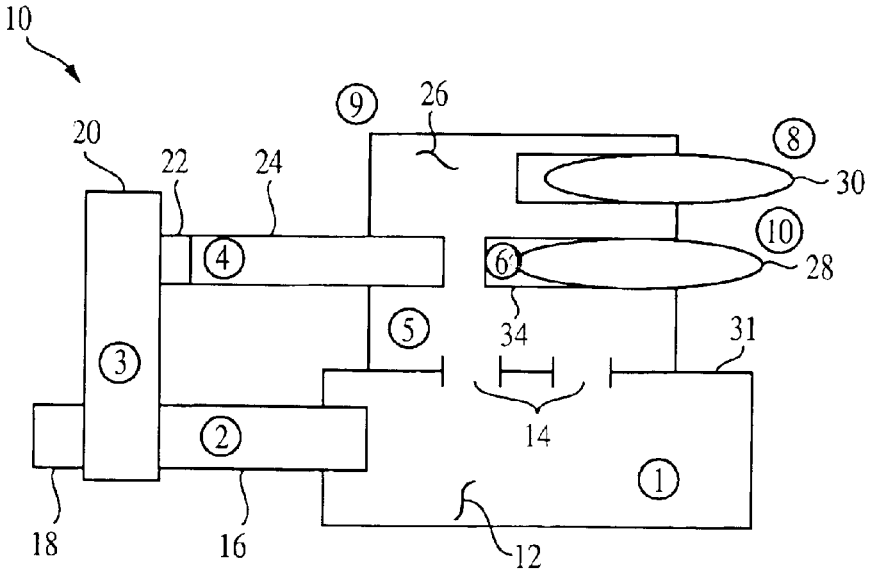
FIG. 2 is a schematic of a launcher for an underwater environment according to a preferred embodiment of the present invention.

In general, the present invention eliminates the need for a conventional intake door by utilizing a D-shaped launcher 10 as shown in FIG. 2. The launcher 10 is referred to; hereinafter, as a shutterway intake launcher (SIL) because the fluid intake and the exit for a torpedo or an unmanned vehicle share the same communication path with the ambient underwater environment.

In further description, the overall structure of the shutterway intake launcher 10 includes an inlet recess 12 having recess communication holes 14 formed in a wall thereof. The inlet recess 12 supplies fluid to an inlet cylinder 16 upon actuation of a pump 18. The pump 18 pumps the fluid into an impulse tank 20, through a slide valve 22, down a launch tube 24, through a shutterway recess 26 and through a primary shutterway 28. A secondary shutterway is shown as component 30 in fluid communication with the other component of the launcher 10.

The recess communication holes 14 penetrate a wall of the inlet recess 12 which defines a corresponding wall 31 of the shutterway recess 26 such that the shutterway intake launcher 10 relies on the intake of fluid through either the primary shutterway 28 or the open secondary shutterway 30 due to the absence of an inlet door in the inlet recess 12. In other words and as will be described below, fluid collected in the shutterway recess 26 is supplied to the inlet recess 12 via the recess communication holes 14.

By way of general understanding, the launch tube 24 is the back of the "D" and the loop of the "D" is a recirculating water path containing the pump 18. In effect, the fluid intake and vehicle or torpedo exit share the same communication path with the ambient environment.

Several aspects of the invention have been examined using analytical and numerical techniques. Of primary interest is the impact of added mass and loss to the existing flow system. Based on the calculated results, it is estimated that there will be minimal changes to the operation of the turbine pump 18 and the basic dynamics of torpedo launch will be unaffected by the proposed system changes.

Continuing with the description, the shutterway intake launcher 10 operates by the intake of fluid through either the operating launch tube (primary shutterway 28) or the open second shutterway 30 to compensate for the loss of fluid flow due to the absence of an inlet door. Furthermore, the shutterway intake launcher 10 operates largely free from pre-launch reverse flow (the system can be pressure-balanced as much as is possible without eliminating leakage flow), such that the launcher does not require an inlet door.

The functioning and operation of the shutterway intake launcher 10 is largely controlled by several performance related phenomenon. These phenomenon include changes in performance of the turbine pump 18 as a result of flow-path changes; effectiveness of pressure balancing due to a closed system operation; launch transient changes as a result of flow-path changes; changes in launch dynamics as a result of launch jet elimination; and changes in flex hose cable dynamics as a result of flow path changes.

The first four of the above phenomena are addressed by formulating a launch system performance model using first principle hydrodynamics concepts. The governing equations for such a model are: conservation of mass, applied at each location where flow streams converge; Newton's equation of motion applied for each fluid mass; Darcy's equation for flow loss applied across each flow restriction; Newton's equation of motion applied for the motion of the vehicle; and an experimental model for transient pump performance.

Although some simplifications are made regarding forces during these transient launch phases, they serve as a primary model for the shutterway intake launcher 10.

FIGS. 3 through 6 illustrate the phases of the launch process including positioning of a vehicle 32, such as a weapon, within the launch tube 24. The arrowheaded lines in the figures indicate a flow of fluid through the shutterway intake launcher 10, while the sequence bubbles correspond to the equations below.

Figure 3:
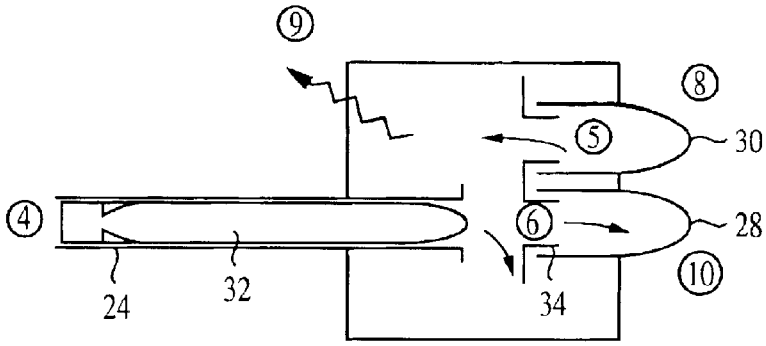
FIG. 3 is a schematic of Phases 1 and 2 of a launch operation of the launcher of the present invention.

Phases 1 and 2 are shown in FIG. 3. Phase 1 is the pre-launch phase of the operation of the shutterway intake launcher 10. During the pre-launch phase, the pump 18 is not actuated but the entire flow path is open. A dynamic head recovered in the shutterway recess 26 drives fluid through the launcher 10. Under these conditions, the pump 18 serves as a flow restriction and is not a source of energy. Other than this slight deviation, the system operates identically as it does in Phase 2 (description to follow) until the weapon 32 contacts the aft end of the torpedo tube or moves forward out of the launch tube 24.

Figure 7:
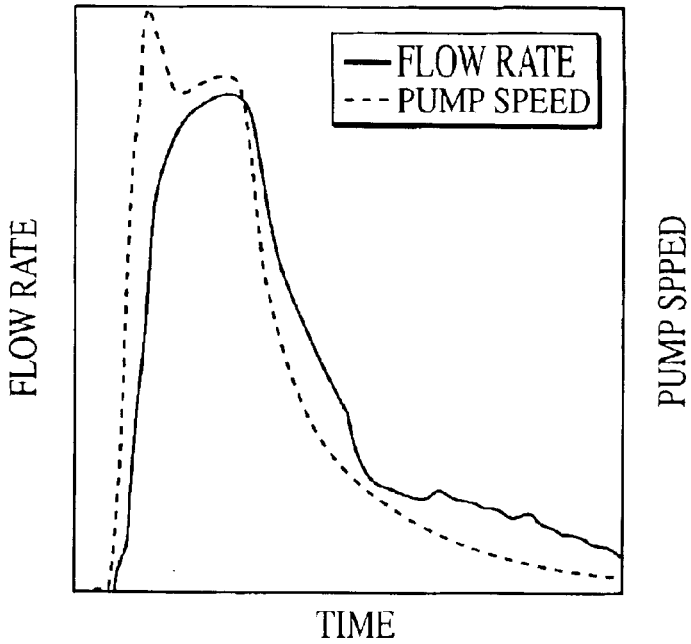
FIG. 7 is a graph relating pump speed and flow rates in support of the present invention.
Figure 8:
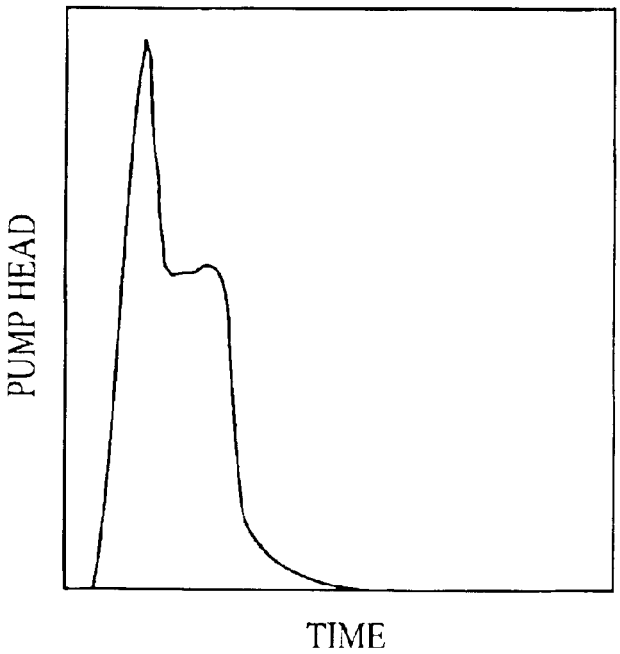
FIG. 8 is a graph relating performance of pump head and time in support of the present invention.

Phase 2 is the initial acceleration of the vehicle 32. During this phase of the launch operation, the turbine pump 18 (see FIG. 2) begins to increase speed. The head developed by the pump 18 is a function of the speed, the flow rate and the transient operating characteristics of the pump. FIGS. 7 and 8 show the performance of the pump 18 as compared to known parameters. FIGS. 7 and 8 are reflective as a guide to the head of the pump 18 versus speed input to the launch operation which determines the relationship between the pressure at points of the inlet cylinder 16 and the impulse tank 20.

In Equation (1), two fluid paths are considered. One path is directly from the launch tube 24 to the guide can 34 and one from the launch tube 24 to the shutterway recess 26 and then back to the launch tube 24.

$$dQ_{4,6}/dt+dQ_{5,6}/dt=dQ_{6,10}/dt+-d^2V_6/dt^2 \quad (1)$$

Conservation of mass is applied in the shutterway recess 26, and in the inlet recess 12. The rate of volume change (dV) of the shutterway recess 26 is equal to the flow (Q) out of the launch tube 24 and into the shutterway recess 26, less the flow out of the shutterway recess 26 and into the inlet recess 12 and the flow out of the shutterway recess 26 through the two open shutterways, i.e.:

$$Q_{4,5} = Q_{5,6} + Q_{5,1} + Q_{5,8} + Q_{5,9} - \frac{dV_5}{dt} \quad (2)$$

or in differential form $$\frac{dQ_{4,5}}{dt} = \frac{dQ_{5,6}}{dt} + \frac{dQ_{5,1}}{dt} + \frac{dQ_{5,8}}{dt} + \frac{dQ_{5,9}}{dt} - \frac{d^2V_5}{dt^2} \quad (3)$$

The rate of volume change (dV) of the shutterway recess 26 is incorporated to account for motion of the vehicle 32 out of the shutterway recess 26 and into a guide can 34. The rate of volume change may also be used to incorporate accumulator effects in the cavity. Leakage to other nonpressure hull regions in the forward end of the ship has been included. Conservation of mass must also be addressed in the guide can 34.

The flow at the intake of the pump 18 is equal to the sum of the flow through the inlet recess 12 and from the shutterway recess 26. In differential form this can be expressed:

$$\frac{dQ_{1,2}}{dt} = \frac{dQ_{6,1}}{dt} + \frac{dQ_{5,1}}{dt} + \frac{dQ_{5,1}}{dt} - \frac{d^2V_1}{dt^2} \tag{4}$$

The differential form, Equations (1) and (4), is useful when relating the flow rates to flow accelerations.

Flow through each portion of the shutterway intake launcher is controlled by the pressure (P) acting over that portion, the mass in the respective portion, and the loss through the portion. It can be shown that the flow rate (Q) from a starting point (A) to an end point (B) can be expressed as:

$$P_A - P_B - \frac{k_{A,B}\rho}{2A^2} Q_{A,B}^2 \left[\frac{Q_{A,B}}{\|Q_{A,B}\|}\right] - \frac{l_{A,B}\rho}{A}\frac{dQ_{A,B}}{dt} = 0 \tag{5}$$

(P) is the pressure with the third term in this expression being the flow loss, which includes a loss coefficient k, the flow area A and the fluid density ρ. The fourth term is the flow acceleration, which includes the effective section length l, the flow area, and the fluid density. If the pipe sections between points A and B contain sections with different flow areas, effective loss and mass terms can be incorporated into Equation (5). The effective loss $K_{A,B}$ is given by $$K_{A,B} = \sum_{i=l,N} \frac{k_i\rho}{2A_i^2} \tag{6}$$

and the effective mass $L_{AB}$ is given by $$L_{A,B} = \sum_{i=l,N} \frac{l_i\rho}{A_i} \tag{7}$$

All losses were referenced to a 21-inch diameter flow area.

Although Equations (6) and (7) are not standard expressions for loss and effective mass, they are useful forms for the current modeling effort. Equation (5) can be modified to include the effects of hull curvature and pressure recovery by adjusting the pressures as appropriate. The recovered pressure $P_R$ and hull pressure distribution is included through adjustment of the ambient pressures $P_\infty$ using $$P_R = P_\infty + \tfrac{1}{2}\rho U_b^2 (C_R + C_P - C_R C_P) \tag{8}$$

where $U_b$ is the boat speed and where the pressure recovery coefficient $C_R$ and pressure coefficient $C_P$ vary between the inlet recess 12 and shutterway recess 26. For simplicity of modeling, it is assumed that this pressure acts along the surface of the submarine hull.

If the instantaneous flow rates are known, the seven flow acceleration equations are generated using Equation (5), the three conservation of mass equations, Equations (1),(2) and (4), and the pump performance functions (derived from FIGS. 7 and 8), form a set of equations which can be solved for the five unknown pressures and five unknown flow accelerations at a specific time during the launch transient. With the flow accelerations expressed in terms of the flow rates and pressures, the equations can be numerically integrated to develop a time history of internal pressures and flow rates during a launch.

A matrix formulation of the problem, Ax=B, is as follows on the successive pages:

$$\begin{bmatrix}
1 & -1 & -1 & 0 & 0 & 0 & 0 & 0 & 0 & 0 & 0 & 0 & 0 \\
1 & 0 & -1 & -1 & -1 & -1 & 0 & 0 & 0 & 0 & 0 & 0 & 0 \\
0 & 0 & 0 & 1 & 0 & 0 & -1 & 0 & 0 & 0 & 0 & 0 & 0 \\
-L_{1,2} & 0 & 0 & 0 & 0 & 0 & 0 & 1 & -1 & 0 & 0 & 0 & 0 \\
0 & 0 & 0 & 0 & 0 & 0 & 0 & 0 & 1 & -1 & 0 & 0 & 0 \\
-L_{3,4} & 0 & 0 & 0 & 0 & 0 & 0 & 0 & 0 & 1 & -1 & 0 & 0 \\
-L_{4,5} & 0 & 0 & 0 & 0 & 0 & 0 & 0 & 0 & 0 & 1 & -1 & 0 \\
0 & 0 & 0 & -L_{5,6} & 0 & 0 & 0 & 0 & 0 & 0 & 0 & 1 & -1 \\
0 & 0 & 0 & 0 & -L_{5,8} & 0 & 0 & 0 & 0 & 0 & 0 & 1 & 0 \\
0 & 0 & 0 & 0 & 0 & -L_{5,9} & 0 & 0 & 0 & 0 & 0 & 1 & 0 \\
0 & 0 & 0 & 0 & 0 & 0 & -L_{6,10} & 0 & 0 & 0 & 0 & 0 & 1 \\
0 & -L_{7,1} & 0 & 0 & 0 & 0 & 0 & -1 & 0 & 0 & 0 & 0 & 0 \\
0 & 0 & -L_{5,1} & 0 & 0 & 0 & 0 & -1 & 0 & 0 & 0 & 1 & 0
\end{bmatrix}. \tag{9}$$

-continued $$\begin{bmatrix} \frac{dQ_{1,2}}{dt} \\ \frac{dQ_{7,1}}{dt} \\ \frac{dQ_{5,1}}{dt} \\ \frac{dQ_{5,6}}{dt} \\ \frac{dQ_{5,8}}{dt} \\ \frac{dQ_{5,9}}{dt} \\ \frac{dQ_{6,10}}{dt} \\ p_1 \\ p_2 \\ p_3 \\ p_4 \\ p_5 \\ p_6 \end{bmatrix} = \begin{bmatrix} -\frac{d^2V_1}{dt^2} \\ -\frac{d^2V_5}{dt^2} \\ -\frac{d^2V_5}{dt^2} \\ K_{1,2}Q_{1,2}^2\left[\frac{Q_{1,2}}{\|Q_{1,2}\|}\right] \\ f(\text{rpm}, t) \\ K_{3,4}Q_{1,2}^2\left[\frac{Q_{1,2}}{\|Q_{1,2}\|}\right] \\ K_{4,5}Q_{1,2}^2\left[\frac{Q_{1,2}}{\|Q_{1,2}\|}\right] \\ K_{5,6}Q_{5,6}^2\left[\frac{Q_{5,6}}{\|Q_{5,6}\|}\right] + P_{R6} \\ K_{5,8}Q_{5,8}^2\left[\frac{Q_{5,8}}{\|Q_{5,68}\|}\right] + P_{R8} \\ K_{5,9}Q_{5,9}^2\left[\frac{Q_{5,9}}{\|Q_{5,9}\|}\right] + P_{R9} \\ K_{6,10}Q_{6,10}^2\left[\frac{Q_{6,10}}{\|Q_{6,10}\|}\right] \\ K_{7,1}Q_{7,1}^2\left[\frac{Q_{7,1}}{\|Q_{7,1}\|}\right] - P_{R7} \\ K_{5,1}Q_{5,1}^2\left[\frac{Q_{5,1}}{\|Q_{5,1}\|}\right] \end{bmatrix}$$

One determination of the present invention is the assessment of the sensitivity of the shutterway intake launcher 10 to variations in the launcher loss coefficient. Consequently, the losses initially selected for the present invention serve as a design point only. The sensitivity of the performance of the shutterway intake launcher 10 to changes about the design point will drive further advances and modifications to the invention.

Figure 4:
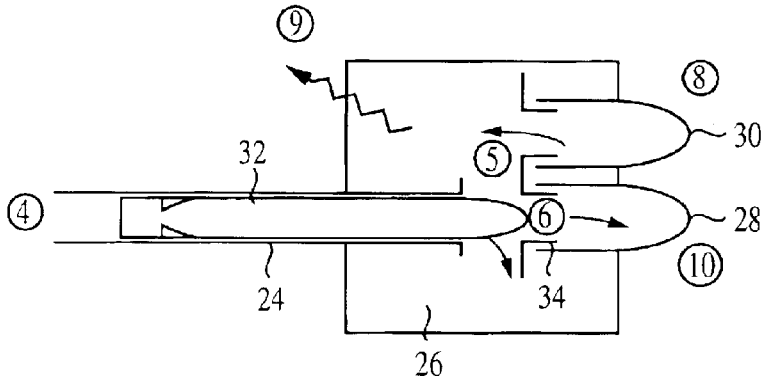
FIG. 4 is a schematic of Phase 3 of the launch operation by the launcher of the present invention.

Phase 3, as shown in FIG. 4, is the initial device exit from the launch tube 24.

As the vehicle 32 begins to exit the launch tube 24, the effective mass of the section from the point of the launch tube 24 to the point of the shutterway recess 26 (FIG. 2.) begins to increase. To correct for this dynamic change, the first element in the $7^{th}$ row of the matrix in Equation (9) should be changed to read:

$$A_{7,1}=L_{4,5}+\rho\delta/A \tag{10}$$

where A is the area and L is the length and δ is the distance which the vehicle protrudes from the launch tube 24.

The effective loss from the launch tube 24 to the shutterway recess 26 drops significantly during Phase 3 of the launch because there is no longer a sudden expansion of fluid. The drag on the nose of the protruding vehicle 32 produces a pressure drop of approximately one fourth of the sudden expansion losses.

The conservation of mass equations remain unchanged as the flow from the launch tube 24 is exactly matched by the displacement of the emerging vehicle 32.

Figure 5:
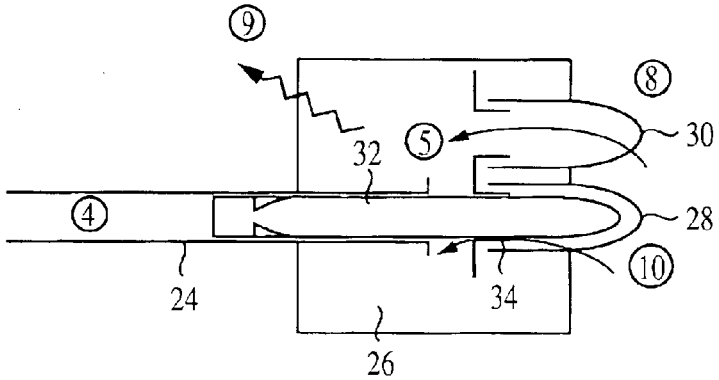
FIG. 5 is a schematic of Phase 4 of the launch operation by the preferred embodiment of the present invention.

Phase 4 is the motion of the vehicle 32 into the guide can 34 and is shown in FIG. 5. As the nose of the vehicle 32 leaves the shutterway recess 26 and enters the guide-can 34, rapid changes in the flow of the fluid in the shutterway intake launcher 10 must be accounted for through the conservation of mass equations.

As in Phase 3 of the launch operation, the effective mass of fluid between the launch tube 24 and the shutterway recess 26 continues to increase as the vehicle 32 travels through the launch tube 24. Equation 9 remains applicable during this phase of the launch operation.

The flow of fluid through the launch tube 24 to the shutterway recess 26 is now governed by the pressure difference between the launch tube 24 and the guide can 34 and the dynamic head produced by the motion of the vehicle 32. The pressure at the guide can 34 includes the effects of ship motion, shutterway pressure recovery, and transients of the shutterway intake launcher 10. The loads which arise due to motion of the vehicle 32 can be approximated using an effective drag coefficient of 0.25 and the internal flow rate of the launcher 10 to determine the vehicle speed.

The flow of fluid through the primary shutterway 28 is still driven by the pressure drop across that opening. However, the loss through that opening is increased substantially as a result of the presence of the exiting vehicle 32 as is the effective mass of the fluid in that region.

Figure 9:
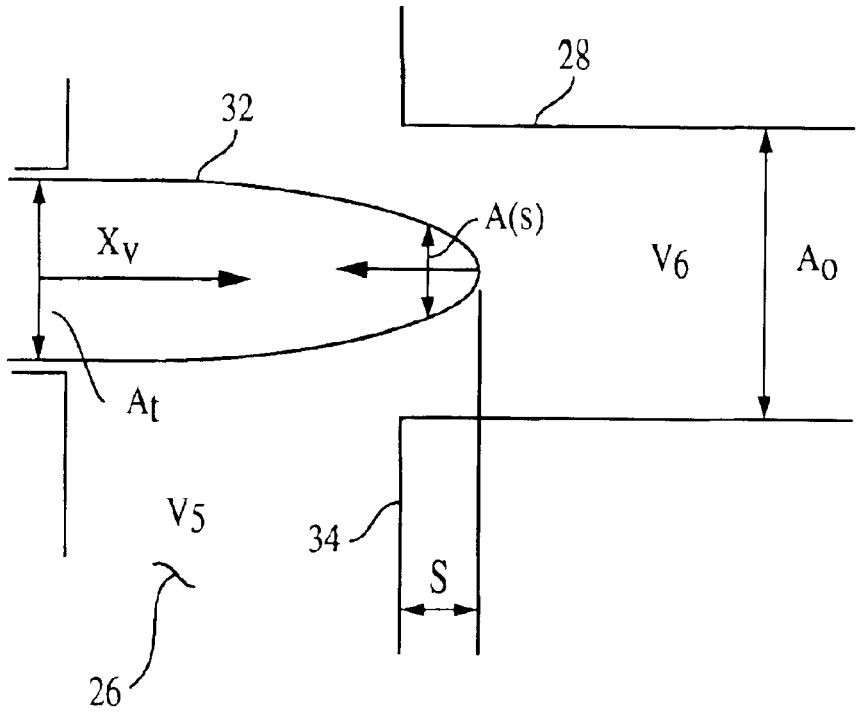
FIG. 9 is a graph showing parameters associated with a launchable vehicle entering a guide can of the launcher of the present invention.

FIG. 9 shows the measurable geometry of the launch operation as the vehicle 32 enters the primary shutterway 28. Initially, the loss coefficient varies with the square of the effective annular area ($A_0$−A(s)). As the vehicle 32 moves further into the guide can 34, an added loss proportional to the penetration depth of the vehicle (s) must be added.

The conservation of mass equations for the shutterway 28 are modified to account for the motion of the vehicle 32. As the vehicle 32 approaches and begins to enter the guide can 34, fluid is displaced from the primary shutterway 28. The fluid is either displaced into the shutterway recess 26 directly or flows along a path external to the ship and then enters the shutterway recess 26 via the secondary shutterway 28 as a leakage path or another leakage path. This fluid displacement or external flow takes place in a very short time and can result in unwanted acceleration of the vehicle 32. Equation 3 can be modified through the second derivative of the volume term to account for this acceleration.

The volume flux into the recesses can be described using $$\dot{V}_6 = A(s)\frac{ds}{dt} \tag{11}$$

and $$\dot{V}_5 = (A_t - A(s))\frac{ds}{dt} \tag{12}$$

The derivative of the rate of the volume flux is related to the velocity of the vehicle 32 by $$-\frac{d^2V_5}{dt^2} + A_t\frac{d^2s}{dt^2} = \frac{d^2V_6}{dt^2} = \frac{ds}{dt}\frac{dA(s)}{dt} + A(s)\frac{d^2s}{dt^2} \tag{13}$$

where ds/dt is the velocity. Because the acceleration of the vehicle 32 is coupled to the pressures and flow rates of the shutterway intake launcher 10, (Equation 13) must be incorporated in the matrix solution (Equation 9). Suitably formulated equations are $$\frac{d^2V_6}{dt^2} = \frac{A(s)}{A_{12}}\frac{dQ_{1,2}}{dt} + \frac{Q_{1,2}^2}{A_{1,2}^2}\frac{dA}{ds} \tag{14}$$

and $$\frac{d^2V_5}{dt^2} = \frac{(A_t - A(s))}{A_{12}}\frac{dQ_{1,2}}{dt} - \frac{Q_{1,2}^2}{A_{1,2}^2}\frac{dA}{ds} \tag{15}$$

For this preliminary analysis, a 90 degree cone was assumed for the vehicle nose shape (to simplify calculation of A(s)).

Figure 6:
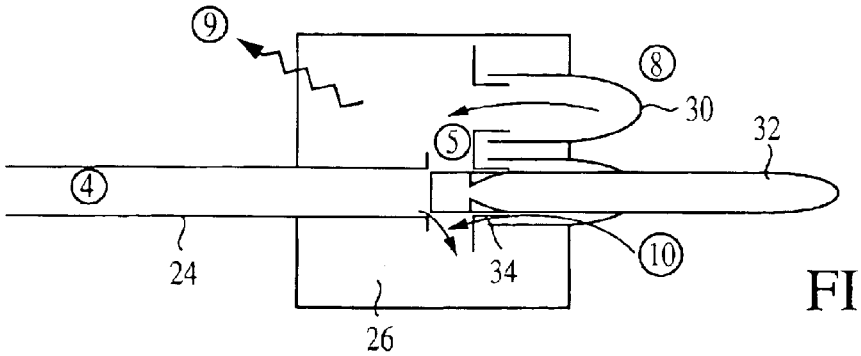
FIG. 6 is a schematic of Phase 5 of the launch operation by the preferred embodiment of the present invention.

Phase 5 is the motion of the vehicle 32 out of the guide can 34 and is shown in FIG. 6. Once the vehicle 32 has cleared the end of the launch tube 24, the dynamics of the launcher 10 revert to the dynamics of Phase 2 between the launch tube 24 and the shutterway recess 26. At this point, the motion dynamics of the vehicle 32 is no longer directly coupled with the internal flow of the launch system 10. The vehicle 32 decelerates based on the pressure difference between the external flow and the shutterway recess 26.

Phase 6 is the weapon clear and is not illustrated. As the vehicle 32 navigates the guide can 34 and the primary shutterway 28, additional transients are expected. However, due to the large areas and volumes at the exit of the primary shutterway 28, these transients will be ignored. The motion of the vehicle 32 is assumed to be uncoupled from the dynamics of the shutterway intake launcher 10 during this phase of the launching operation.

Figure 1:
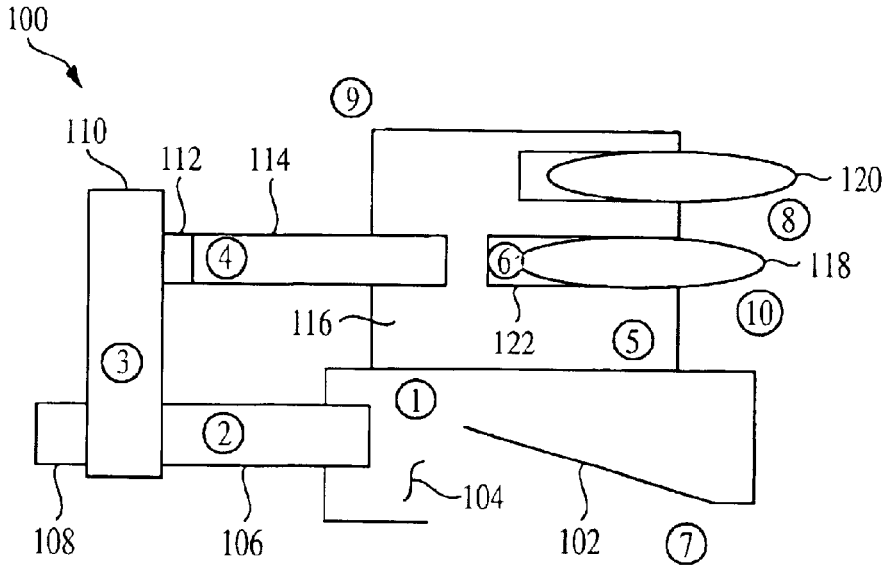
FIG. 1 (PRIOR ART)
FIG. 1 is a schematic of a prior art turbine pump ejection system for launching a device.
Figure 10:
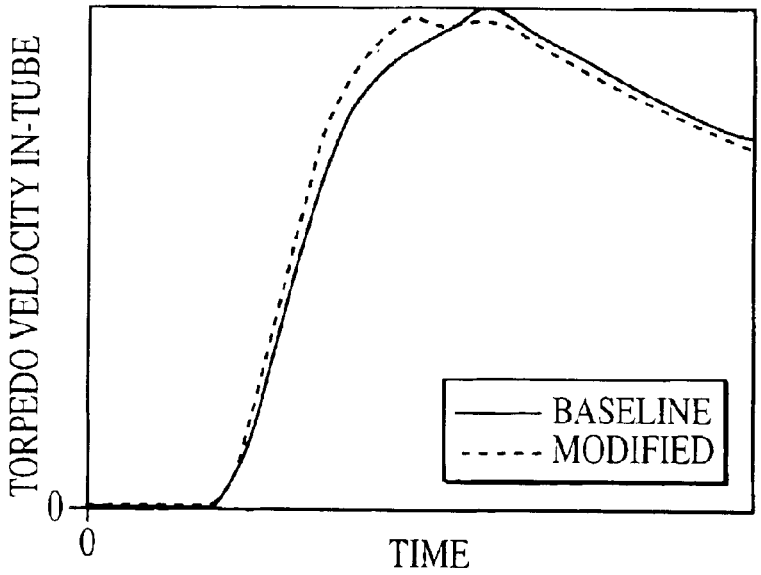
FIG. 10 is a graph depicting a comparison of base-line system performance of the prior art and modified system performance of the launcher of the present invention.

FIG. 10 depicts a comparison of the predicted transient launch velocities for both the base-line configuration based on the prior art of FIG. 1 and for the modified configuration of the shutterway intake launcher 10 shown in FIG. 2. The most significant system performance change is the transients generated as the vehicle 32 exits the tube. These transients are the result of the assumed behavior of the jet of fluid which precedes the vehicle 32.

Preliminary calculations regarding the shutterway intake launcher 10 indicate a similar tube exit velocity for both the baseline and modified systems. Added flow losses associated with the operation of the shutterway intake launcher 10 are small.

During operation of the shutterway intake launcher 10, the effective mass of the system is less than the effective mass of the system during an open loop operation. The water-hammer effect as the vehicle 32 enters the shutterway 28 can produce large accelerations and pressure transients in the shutterway intake launcher 10.

Because of the transient effects as the vehicle 32 enters the shutterway 28, either a means to reduce the added mass of the guide can 34 must be found or a depth independent accumulator system must be added to the shutterway intake launcher 10.

The added mass associated with the shutterway 28 can be reduced by either increasing the area of the inlet recess 12 or by shortening the path from the external flow to the shutterway recess 26. The path can be reduced by machining holes somewhere in the boundary between the shutterway recess 26 and the external flow. Holes already incorporated into the shutterways to reduce pressure recovery may provide the mass reduction needed.

The advantages of the shutterway intake launch system 10 include a solution to the reverse-flow problem, and the provision of a pressure-balanced system.

Alternatives to the concept presented herein include: An inlet door as a part of a launcher system with the lowest tubes in the submarine torpedo banks isolated from the upper tubes and also connected to the inlet chamber. As such the upper tubes can operate in a standard fashion (drawing water through the inlet door) and the lower tubes can be operated as the shutterway intake launcher concept. Further, an accumulator can be added to the system to eliminate any water hammer effects.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A launcher, said launcher comprising:

a first fluid chamber with an interior of said first fluid chamber defining a shutterway recess;

a second fluid chamber with an interior of said second fluid chamber defining an inlet recess in a first fluid communication path with said shutterway recess;

a pump interposed in a second fluid communication path from said inlet recess to said shutterway recess;

a launch tube positioned within said second fluid communication path between said pump and said shutterway recess;

a tank positioned within said second fluid communication path intermediate said pump and said launch tube, said tank capable of storage of pressurized fluid as an impulse force for launching a vehicle from said launch tube; and at least one shutterway encompassed by said shutterway recess, said shutterway capable of launch of a vehicle to an exterior environment from a guide and capable of fluid intake from the exterior environment wherein a common egress of the fluid intake and vehicle launch allows a balance of the pressurized fluid within said launcher.

2. The launcher in accordance with claim 1 wherein said pump restricts flows of the fluid intake in said second fluid communication path in a pre-launch phase when said shutterway recess is open for the fluid intake.

3. The launcher in accordance with claim 1 wherein a speed of said pump is variable to control the fluid intake forming a pressure head for the pressurized fluid at said launch tube in an initial acceleration phase.

4. The launcher in accordance with claim 2 wherein a speed of said pump is variable to control the fluid intake forming a pressure head for the pressurized fluid at said launch tube in an initial acceleration phase.

5. The launcher in accordance with claim 1 further comprising a valve positioned within said second fluid communication path for controlling the fluid intake to said launch tube.

6. A system for launching a vehicle in an underwater environment, said system comprising:

a common means for intake of fluid from the underwater environment and for ejecting the vehicle from said system as a launch of the vehicle; and a means for pressurizing the fluid as a driving force in support of said ejecting means.

* * * * *